US008760352B2

(12) United States Patent
Rao et al.

(10) Patent No.: US 8,760,352 B2
(45) Date of Patent: Jun. 24, 2014

(54) MOBILE DEVICE AND ANTENNA ARRAY THEREOF

(75) Inventors: Pei-Zong Rao, Taoyuan County (TW); Wei-Shin Tung, Taoyuan County (TW); Wan-Ming Chen, Taoyuan County (TW); Hsin-Chia Lu, Taoyuan County (TW); Yi-Long Chang, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 181 days.

(21) Appl. No.: 13/435,867

(22) Filed: Mar. 30, 2012
(Under 37 CFR 1.47)

(65) Prior Publication Data

US 2013/0257668 A1 Oct. 3, 2013

(51) Int. Cl.
*H01Q 1/24* (2006.01)

(52) U.S. Cl.
USPC ..... 343/702; 343/873

(58) Field of Classification Search
USPC ..... 343/702, 725, 873, 893
See application file for complete search history.

(56) References Cited

U.S. PATENT DOCUMENTS

| | | | | |
|---|---|---|---|---|
| 4,975,711 | A | 12/1990 | Lee | |
| 5,608,413 | A | 3/1997 | MacDonald | |
| 6,456,242 | B1 | 9/2002 | Crawford | |
| 6,507,322 | B2 | 1/2003 | Fang et al. | |
| 7,034,762 | B2 | 4/2006 | Huang | |
| 7,471,251 | B2 | 12/2008 | Kawasaki et al. | |
| 8,160,498 | B2 * | 4/2012 | Rofougaran | 455/41.3 |
| 2005/0146475 | A1 | 7/2005 | Bettner et al. | |
| 2013/0257668 | A1 | 10/2013 | Rao et al. | |

FOREIGN PATENT DOCUMENTS

| | | | |
|---|---|---|---|
| DE | 10 2013 204 368 | A1 | 10/2013 |
| EP | 1 168 658 | A1 | 1/2002 |
| EP | 1 411 587 | * | 4/2004 |
| WO | 98/37590 | A2 | 8/1998 |
| WO | WO 03/017425 | A1 | 2/2003 |

OTHER PUBLICATIONS

Highly Integrated 60 GHz Radio Transceiver Chipset, published on Jul. 12,2012; Microwave Journal; Hittite Microwave Corp. Chelmsford, MA; pp. 1-6.

HMC6000LP711E, Millimeterwave Transmitter 57-64 GHz; Hittite; Microwave Corporation v00.1112; pp. 1-18.

* cited by examiner

*Primary Examiner* — Hoang V Nguyen
(74) *Attorney, Agent, or Firm* — Birch, Stewart, Kolasch & Birch, LLP

(57) ABSTRACT

A mobile device at least includes a dielectric substrate, an antenna array, and a transceiver. The antenna array includes a first antenna, a second antenna, and a third antenna. The third antenna is disposed between the first and second antennas so as to reduce coupling between the first and second antennas. The first, second and third antennas are all embedded in the dielectric substrate and substantially arranged in a straight line. Each of the first and second antennas is a transmission antenna and the third antenna is a reception antenna, or each of the first and second antennas is a reception antenna and the third antenna is a transmission antenna. The transceiver is coupled to the antenna array and is configured to transmit or receive a signal.

21 Claims, 11 Drawing Sheets

MOBILE DEVICE AND ANTENNA ARRAY THEREOF

BACKGROUND OF THE INVENTION

1. Field of the Invention

The subject application generally relates to a mobile device, and more particularly, relates to a mobile device for improving isolation between a plurality of antennas in an antenna array. The speed at which the mobile device transmits high-resolution audio/video data to other display device interfaces is also improved.

2. Description of the Related Art

With the progress of mobile communication technology, a camera or video recorder in a mobile device can retrieve high-resolution images and videos. Some high-end mobile devices use HDMI (High-Definition Multimedia Interface) cables as an interface to transmit high-resolution audio/video data to other display devices. However, it is more convenient for people to use wireless transmission, in particular to a 60 GHz band which has sufficient bandwidth for transmitting high-quality video data.

Traditionally, an antenna array for transmitting data usually occupies a lot of space in a mobile device. Furthermore, mutual coupling between a plurality of antennas is serious, and the transmission speed is bad. This decreases communication quality of the mobile device.

BRIEF SUMMARY OF THE INVENTION

In one exemplary embodiment, the subject application is directed to a mobile device, at least comprising: a dielectric substrate; an antenna array, comprising: a first antenna; a second antenna; and a third antenna, positioned between the first antenna and the second antenna so as to reduce coupling between the first antenna and the second antenna, wherein the first antenna, the second antenna and the third antenna are embedded in the dielectric substrate, and are substantially arranged in a straight line; and wherein each of the first antenna and the second antenna is a transmission antenna and the third antenna is a reception antenna, or each of the first antenna and the second antenna is the reception antenna and the third antenna is the transmission antenna; and a transceiver, coupled to the antenna array, and configured to transmit or receive a signal.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

Figure 1A:
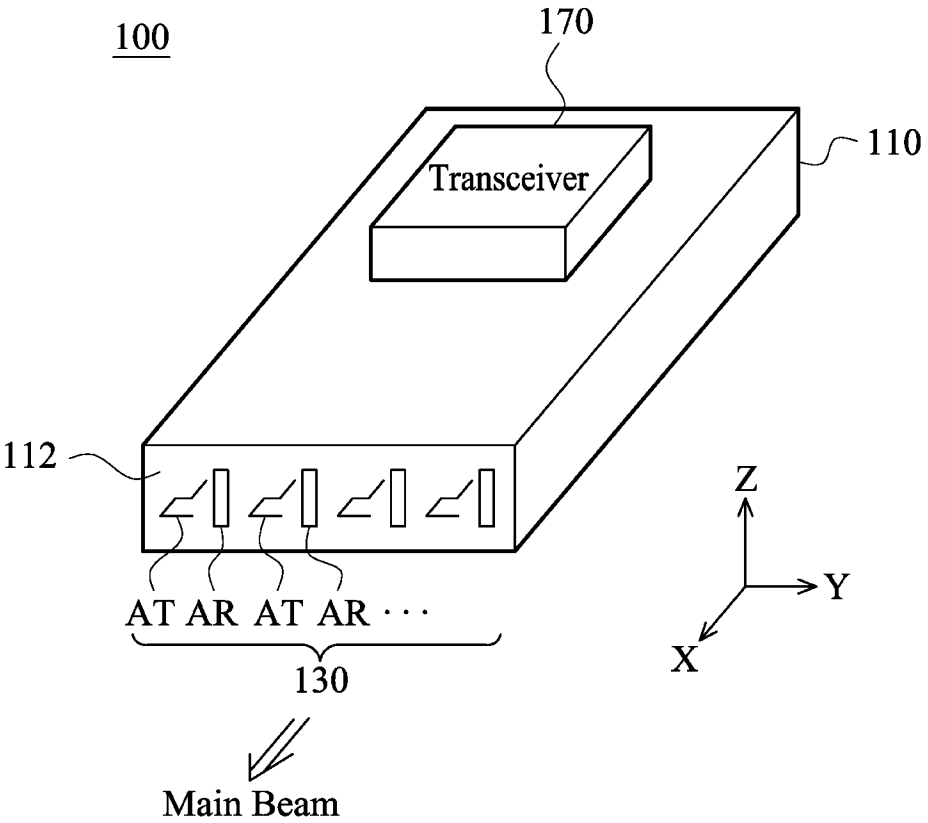
FIG. 1A is a pictorial drawing for illustrating a mobile device according to an embodiment of the invention.

FIG. 1A is a pictorial drawing for illustrating a mobile device 100 according to an embodiment of the invention. The mobile device may be a smart phone, a tablet, or a notebook. As shown in FIG. 1A, the mobile device at least comprises a dielectric substrate 110, an antenna array 130, and a transceiver 170. A skilled person in the art can comprehend that the mobile device 100 may further comprise a processor, a display module, a touch module, an input module, and other electronic components even if they are not shown in FIG. 1A. In some embodiments, the dielectric substrate 110 is an FR4 substrate or an LTCC (Low Temperature Co-fired Ceramics) substrate, and the transceiver 170 is a TR (Transmission and Reception) chip disposed on the dielectric substrate 110. The transceiver 170 is electrically coupled to the antenna array 130, and is configured to transmit or receive a signal.

The antenna array 130 is close to a lateral edge 112 of the dielectric substrate 110 so as to generate end-fire radiation, for example, substantially toward an X-direction in FIG. 1A. In an embodiment, the transceiver 170 is configured to adjust a main beam of the antenna array 130 toward a specific direction, which may be a reception direction of other display device interfaces (e.g., a monitor, a television, a projector, or a mobile device). The antenna array 130 comprises one or more transmission antennas AT for transmitting signals and one or more reception antennas AR for receiving signals. Since the transmission antennas AT are interleaved with the reception antennas AR, the isolation between the transmission antennas AT and/or the isolation between the reception antennas AR can be improved. In addition, all of the transmission antennas AT and the reception antennas AR of the antenna array 130 are embedded in the dielectric substrate 110, and the surface of the dielectric substrate 110 has sufficient space to accommodate other components, such as a TR chip. In an embodiment, the reception antennas AR and/or the transmission antennas AT are slot antennas, monopole antennas, dipole antennas, or Yagi antennas.

Figure 1B:
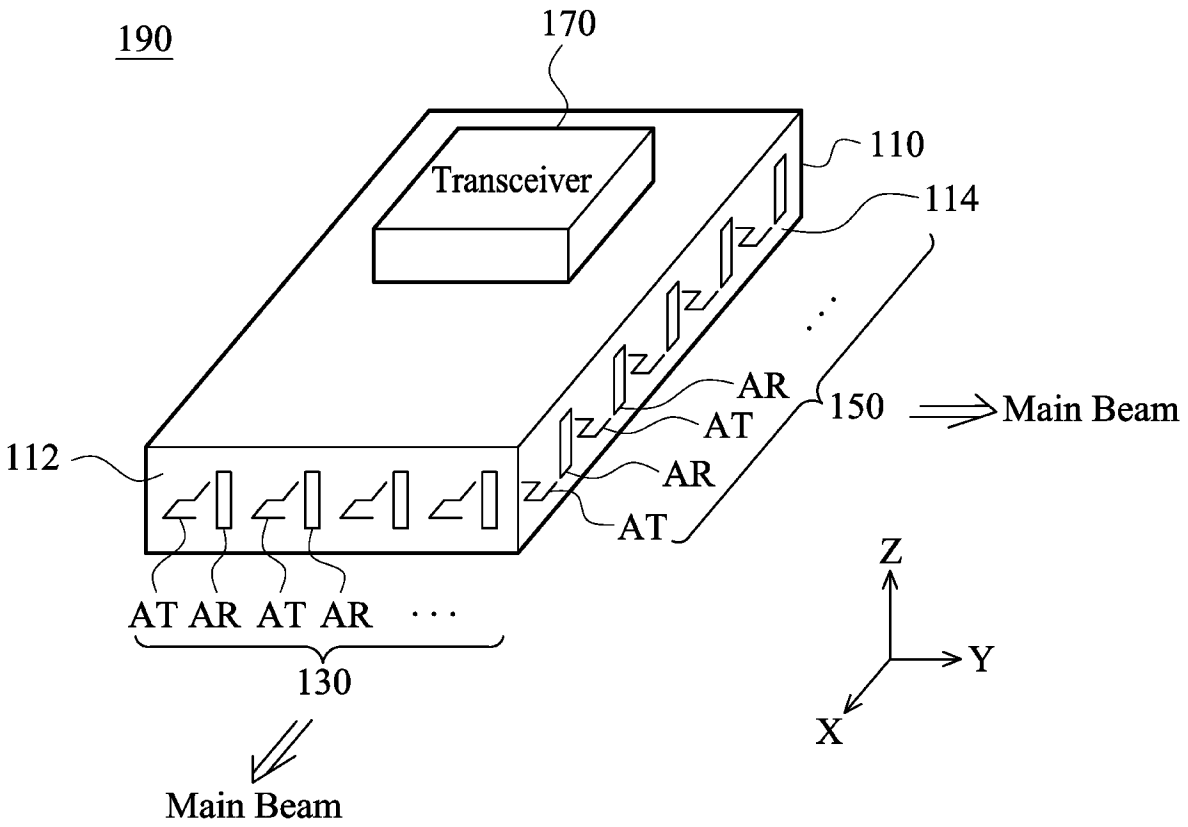
FIG. 1B is a pictorial drawing for illustrating a mobile device according to another embodiment of the invention.

FIG. 1B is a pictorial drawing for illustrating a mobile device 190 according to another embodiment of the invention. As shown in FIG. 1B, the mobile device 190 further comprises another antenna array 150 close to another lateral edge 114 of the dielectric substrate 110 so as to generate end-fire radiation, wherein the lateral edge 114 is substantially perpendicular to the lateral edge 112. In the embodiment, the main beam of the antenna array 130 is substantially toward the X-direction, and the main beam of the antenna array 150 is substantially toward a Y-direction. Similarly, the transceiver 170 is configured to dynamically adjust the main beams of the antenna arrays 130 and 150 toward a specific direction parallel to a reception direction of another display device interface.

Figure 2:
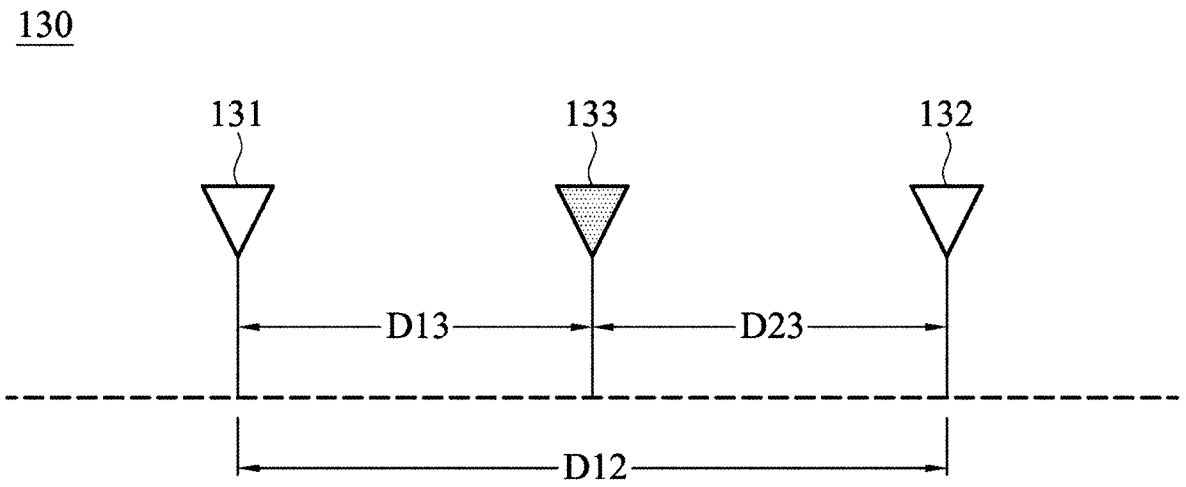
FIG. 2 is a diagram for illustrating an antenna array according to an embodiment of the invention.

FIG. 2 is a diagram for illustrating the antenna array 130 (or 150) according to an embodiment of the invention. As shown in FIG. 2, the antenna array 130 (or 150) comprises at least three antennas 131, 132 and 133. The antenna 133 is positioned between the antennas 131 and 132 so as to reduce coupling between the antennas 131 and 132. Note that the two adjacent antennas should be of different types to improve isolation. In an embodiment, each of the antennas 131 and 132 is a transmission antenna AT, and the antenna 133 is a reception antenna AR. In another embodiment, each of the antennas 131 and 132 is a reception antenna AR, and the antenna 133 is a transmission antenna AT. Note that since the antennas 131 and 132 are of the same type, a synthetic beam is formed by switching and adjusting the transceiver 170, and further by altering input phase and input energy of the antenna 131 and 132 so as to dynamically adjust the main beams of the antenna arrays 130 and 150. Therefore, other display device interfaces can have the optimal transmission and reception quality to increase the efficiency of wireless transmission. In a preferred embodiment, the antennas 131, 132 and 133 are all embedded in the dielectric substrate 110 and are substantially arranged in a straight line. The distance D12 between the antennas 131 and 132 is approximately half wavelength (an) of a central operating frequency of the antenna array 130. In another embodiment, the distance D13 between the antennas 131 and 133 is approximately equal to the distance D23 between the antennas 132 and 133. The antenna array 130 (or 150) may comprise more transmission antennas AT and more reception antennas AR as shown in FIG. 1A.

Figure 3A:
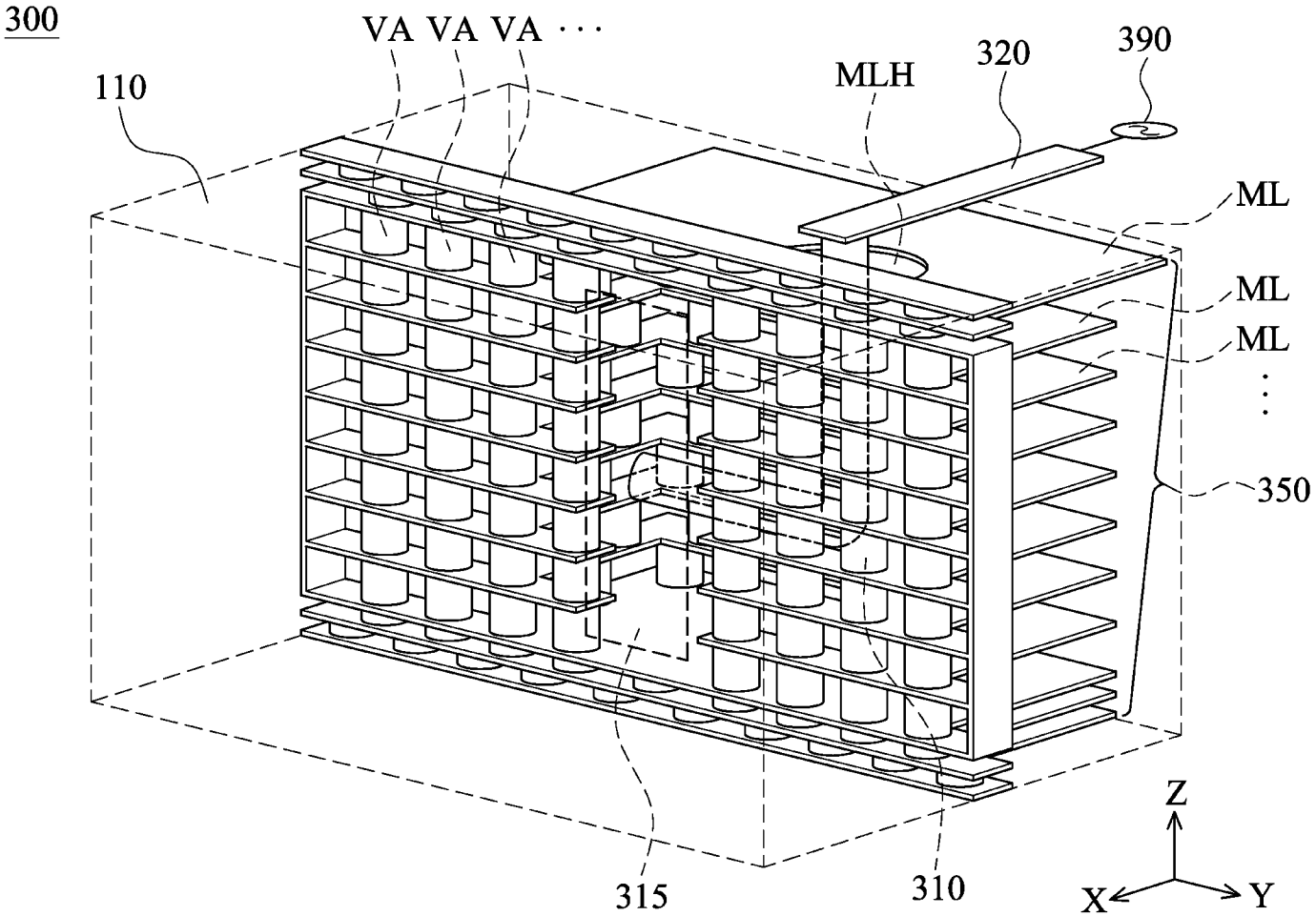
FIG. 3A is a pictorial drawing for illustrating a slot antenna according to an embodiment of the invention.
Figure 3B:
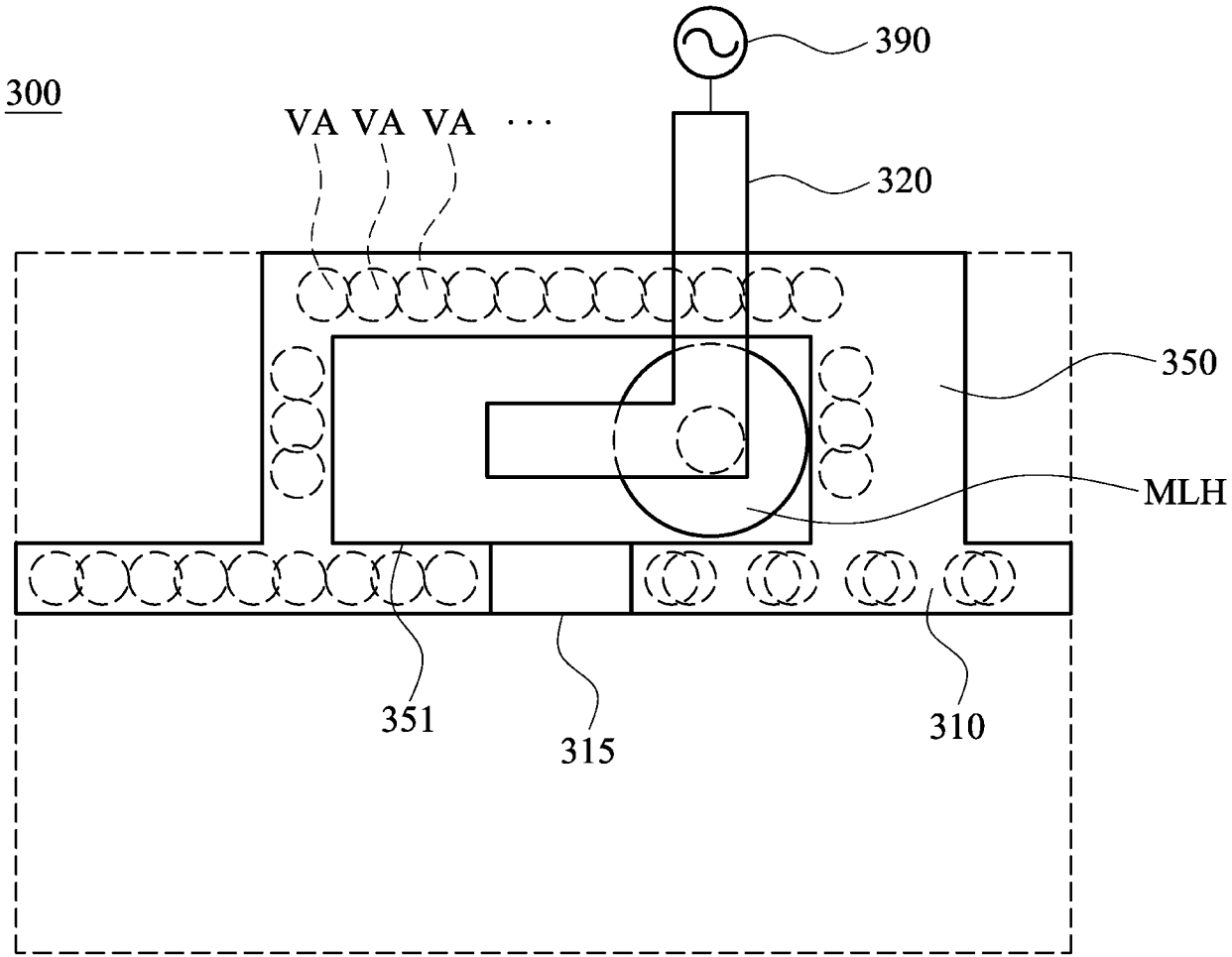
FIG. 3B is a vertical view for illustrating the slot antenna according to the embodiment of the invention.

FIG. 3A is a pictorial drawing for illustrating a slot antenna 300 according to an embodiment of the invention. FIG. 3B is a vertical view for illustrating the slot antenna 300 according to the embodiment of the invention. In a preferred embodiment, each reception antenna AR in the antenna array 130 (or 150) is a slot antenna 300 embedded in the dielectric substrate 110. As shown in FIGS. 3A and 3B, the slot antenna 300 comprises a ground structure 310, a feeding element 320, and a cavity structure 350. The ground structure 310, the feeding element 320 and the cavity structure 350 are all made of metal, such as aluminum or copper. The ground structure 310 is substantially flat and has a slot 315, which is parallel to the ground structure 310. The feeding element 320 is electrically coupled to a signal source 390 and extends across the slot 315 of the ground structure 310 such that the slot antenna 300 is excited. The cavity structure 350 is substantially a hollow metal housing and is electrically coupled to the ground structure 310. An open side 351 of the cavity structure 350 faces the slot 315 of the ground structure 310. The cavity structure 350 is configured to reflect electromagnetic waves to enhance the gain of the slot antenna 300. In other embodiments, the cavity structure 350 is removed from the slot antenna 300. In a preferred embodiment, the dielectric substrate 110 is an LTCC substrate which comprises a plurality of metal layers ML and a plurality of vias VA, and the ground structure 310 and the cavity structure 350 are formed by some of the plurality of metal layers ML and some of the plurality of vias VA. The plurality of vias are electrically coupled between the plurality of metal layers ML. In order to avoid leakage waves, the distance between any two adjacent vias VA should be smaller than 0.125 wavelength ($\lambda/8$) of a central operating frequency of the antenna array 130. The feeding element 320 may further extend through a circular hole MLH in the top metal layer ML into an interior of the cavity structure 350. In an embodiment, the feeding element 320 comprises a microstrip line or a stripline.

Figure 4:
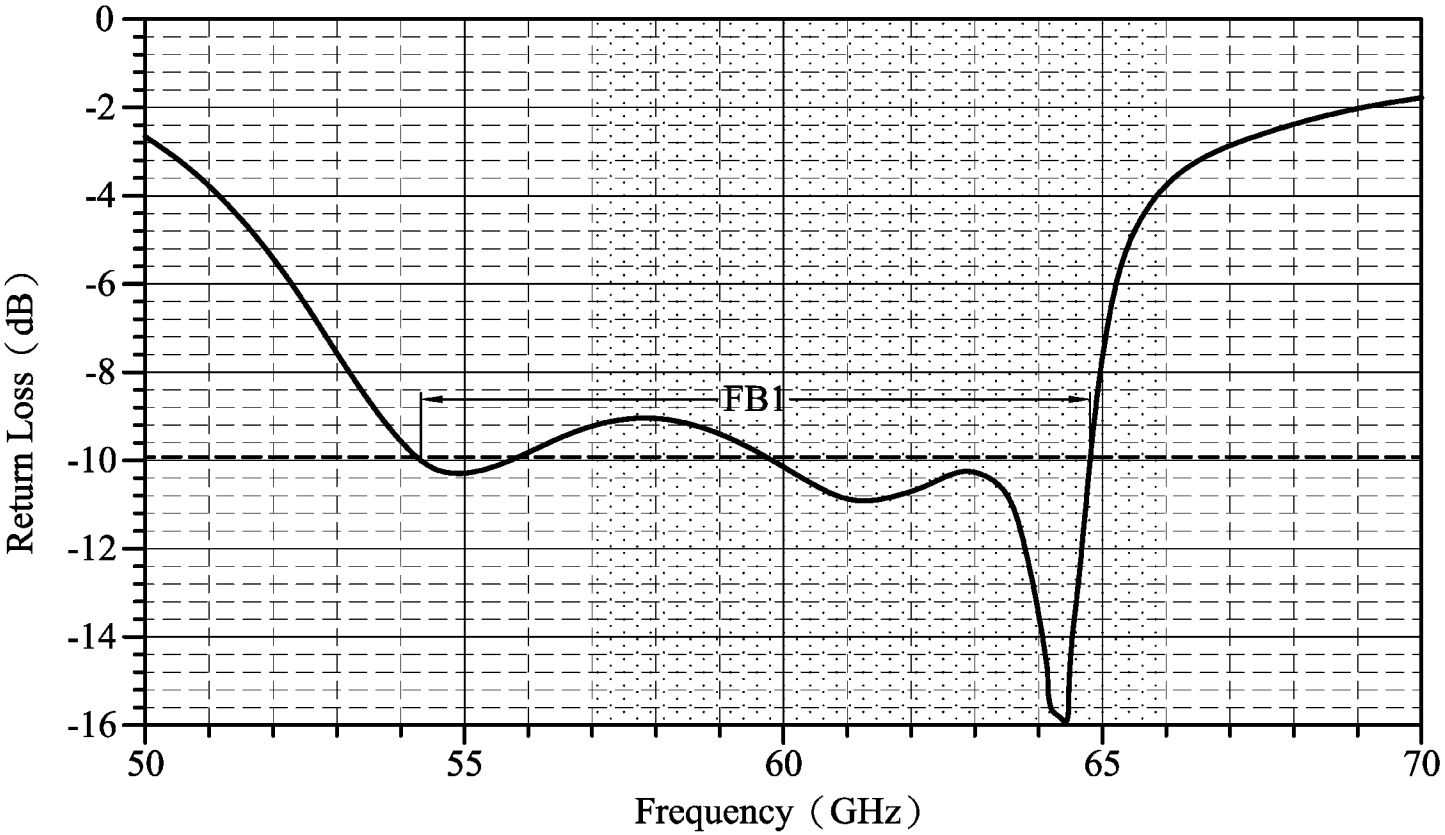
FIG. 4 is a diagram for illustrating return loss of the slot antenna according to an embodiment of the invention.

FIG. 4 is a diagram for illustrating return loss of the slot antenna 300 according to an embodiment of the invention. The vertical axis represents return loss (unit: dB), and the horizontal axis represents operating frequency (unit: GHz). As shown in FIG. 4, the slot antenna 300 is excited to form a frequency band FB1 which is approximately from 57 GHz to 66 GHz. Therefore, the slot antenna 300 is capable of covering the 60 GHz band.

Figure 5A:
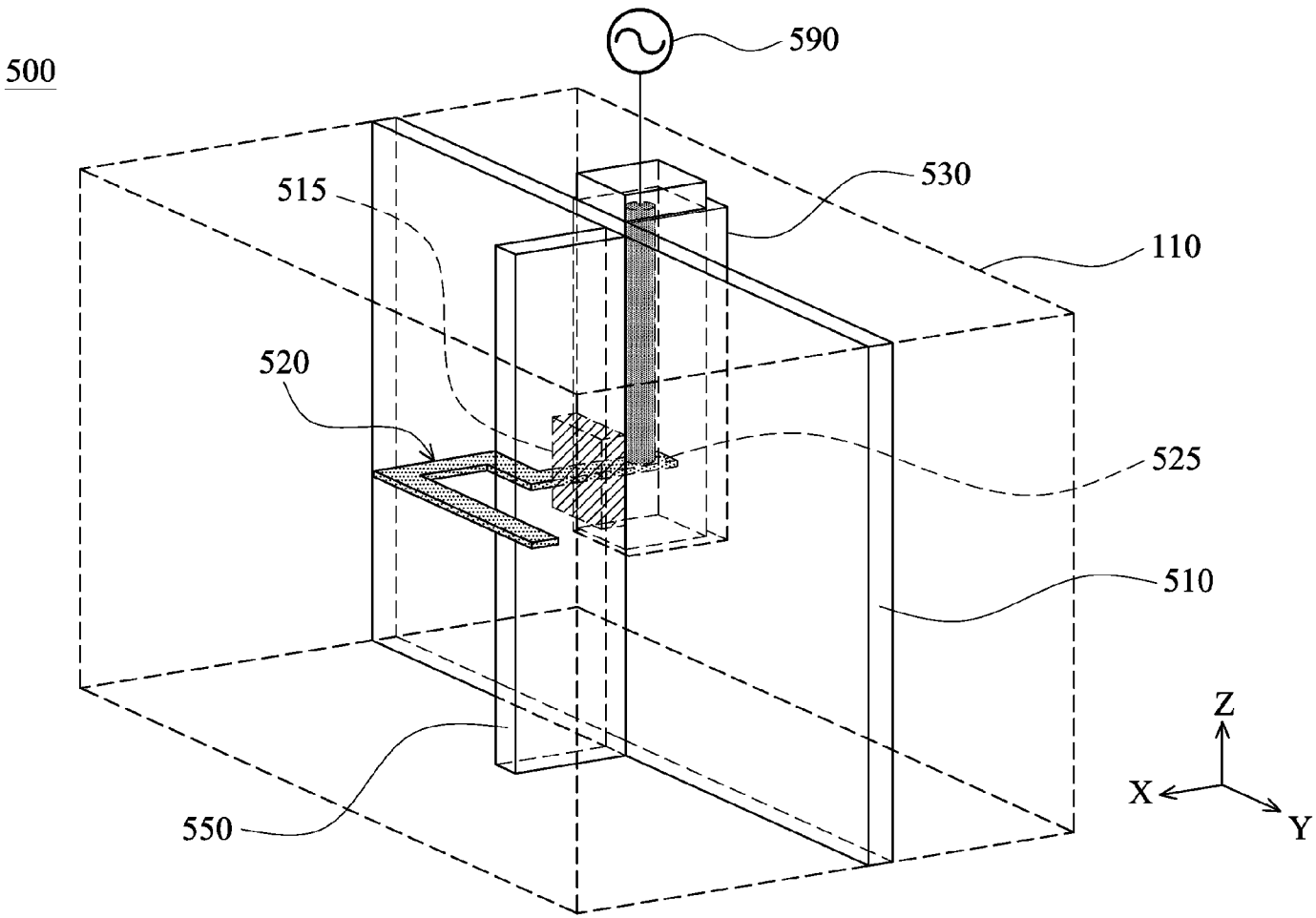
FIG. 5A is a pictorial drawing for illustrating a monopole antenna according to an embodiment of the invention.
Figure 5B:
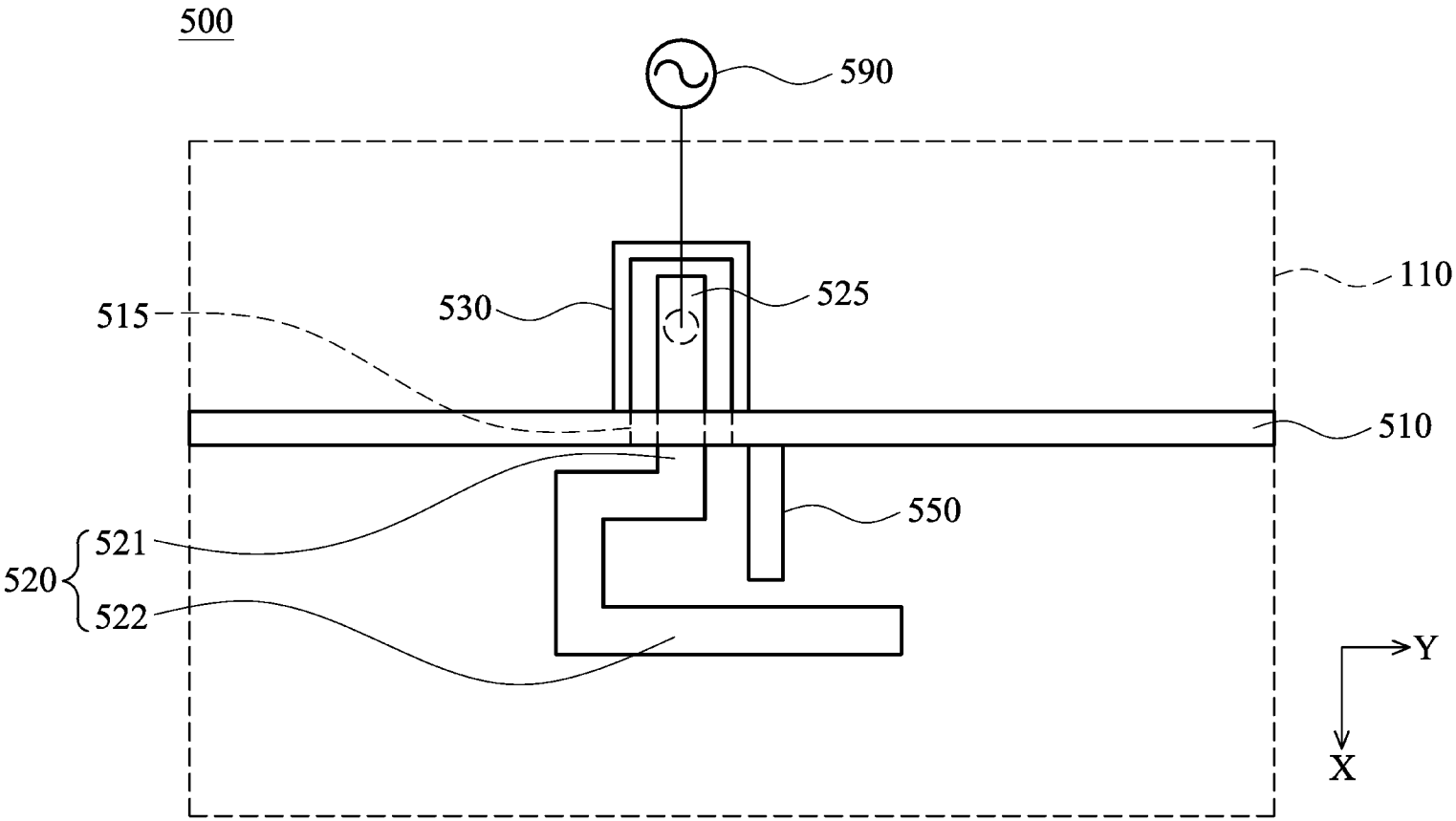
FIG. 5B is a vertical view for illustrating the monopole antenna according to the embodiment of the invention.

FIG. 5A is a pictorial drawing for illustrating a monopole antenna 500 according to an embodiment of the invention. FIG. 5B is a vertical view for illustrating the monopole antenna 500 according to the embodiment of the invention. In a preferred embodiment, each transmission antenna AT in the antenna array 130 (or 150) is a monopole antenna 500 embedded in the dielectric substrate 110, and extends in a direction perpendicular to the dielectric substrate 110 (e.g., the X-direction). As shown in FIGS. 5A and 5B, the monopole antenna 500 comprises a ground structure 510, a main radiation element 520, a feeding element 530, and a reflection structure 550 that are all made of metal, such as aluminum or copper. The ground structure 510 is substantially flat and has a small hole 515. One end 525 of the main radiation element 520 extends through the small hole 515 of the ground structure 510 perpendicularly. In an embodiment, the main radiation element 520 comprises two radiation sub-elements, an I-shaped radiation sub-element 521 and a J-shaped radiation sub-element 522. The I-shaped radiation sub-element 521 extends through the small hole 515 of the ground structure 510, and the J-shaped radiation sub-element 522 is electrically coupled to one end of the I-shaped radiation sub-element 521. In other embodiments, the main radiation element 520 has other shapes, such as an I-shape, a C-shape, or a Z-shape. The feeding element 530 is electrically coupled to the end 525 of the main radiation element 520, and is further electrically coupled to a signal source 590. In an embodiment, the feeding element 530 comprises a rectangular coaxial cable which is substantially parallel to the ground structure 510 and substantially perpendicular to the main radiation element 520. The reflection structure 550 is substantially flat. The reflection structure 550 is electrically coupled to the ground structure 510 and substantially perpendicular to the ground structure 510. The reflection structure 550 is close to the main radiation element 520 so as to reflect electromagnetic waves and adjust the radiation pattern of the monopole antenna 500. In other embodiments, the reflection 550 is removed from the monopole antenna 500. Similarly, in a preferred embodiment, the dielectric substrate 110 is an LTCC substrate which comprises a plurality of metal layers and a plurality of vias. Although not shown in FIGS. 5A and 5B, the ground structure 510 and the reflection 550 may be formed by some of the plurality of metal layers and some of the plurality of vias. Note that if the slot antenna 300 is adjacent to the monopole antenna 500, the ground structure 310 in FIG. 3A is electrically coupled to the ground structure 510 in FIG. 5A.

Figure 6:
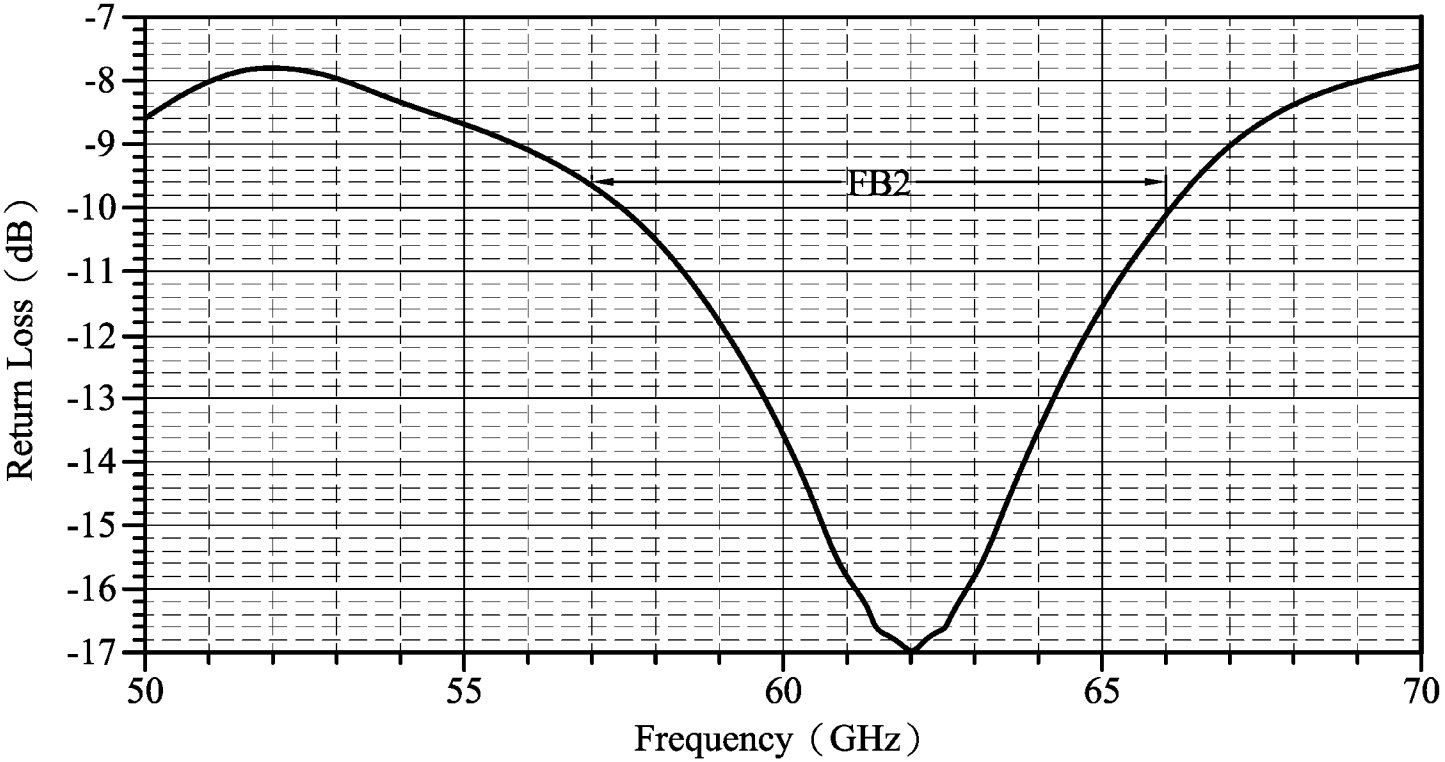
FIG. 6 is a diagram for illustrating return loss of the monopole antenna according to an embodiment of the invention.

FIG. 6 is a diagram for illustrating return loss of the monopole antenna 500 according to an embodiment of the invention. The vertical axis represents return loss (unit: dB), and the horizontal axis represents operating frequency (unit: GHz). As shown in FIG. 6, the monopole antenna 500 is excited to form a frequency band FB2 which is approximately from 57 GHz to 66 GHz. Therefore, the monopole antenna 500 is capable of covering the 60 GHz band. According to FIGS. 4 and 6, the antenna array 130 (or 150) is capable of covering an array band which is approximately from 57 GHz to 66 GHz.

Figure 7:
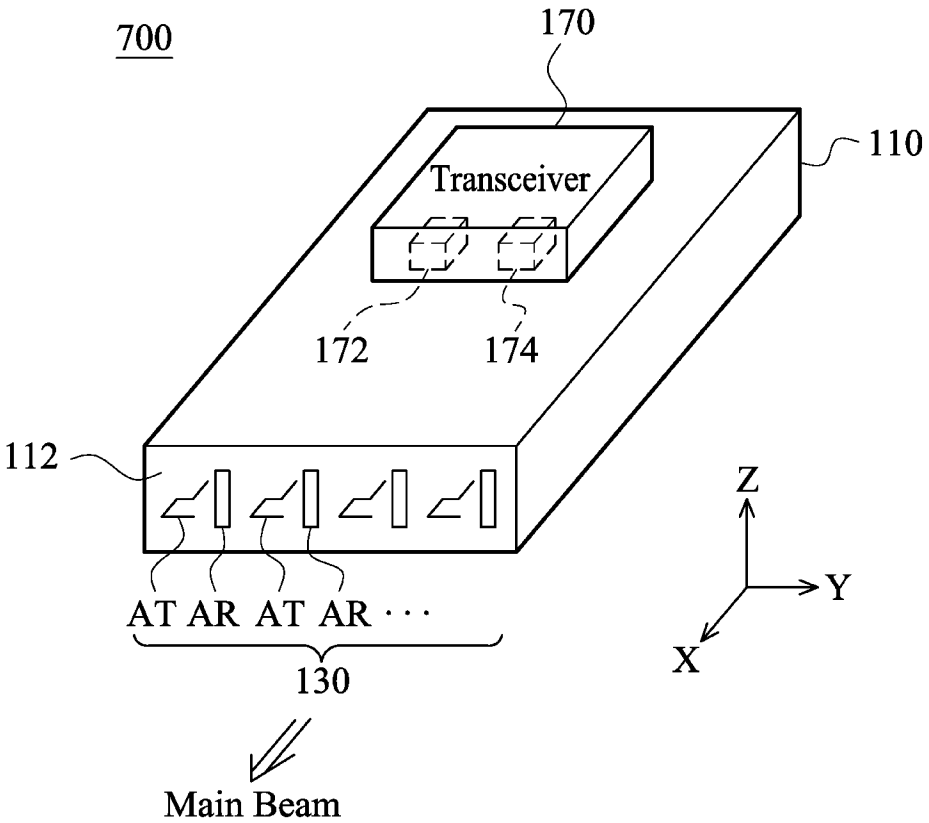
FIG. 7 is a pictorial drawing for illustrating a mobile device according to an embodiment of the invention.

FIG. 7 is a pictorial drawing for illustrating a mobile device 700 according to an embodiment of the invention. As shown in FIG. 7, a transceiver 170 of the mobile device 700 comprises a TR (Transmission and Reception) switch 172 and a tuner 174. The TR switch 172 is configured to exchange the functions of the transmission antenna AT and the reception antenna AR. In other words, the transmission antenna AT can receive signals, and the reception antenna AR can transmit signals. The tuner 174 is configured to dynamically adjust the main beam of the antenna array 130 toward a specific direction (e.g., toward a reception direction of other display device interfaces). The TR switch 172 and the tuner 174 may be a portion of circuits in a TR chip. In other embodiments, the TR switch 172 is independent of the transceiver 170.

Figure 8:
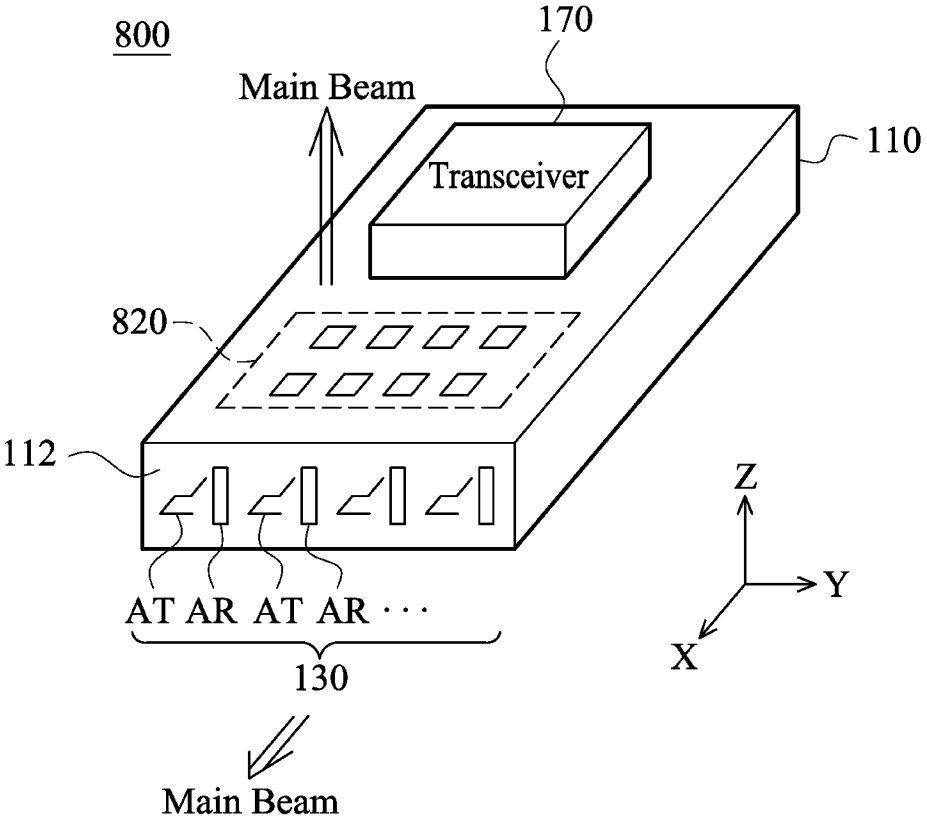
FIG. 8 is a pictorial drawing for illustrating a mobile device according to another embodiment of the invention.

FIG. 8 is a pictorial drawing for illustrating a mobile device 800 according to another embodiment of the invention. As shown in FIG. 8, the mobile device 800 further comprises another antenna array 820 which is disposed on a surface of the dielectric substrate 110 and is electrically coupled to the transceiver 170. In the embodiment, the main beam of the antenna array 130 is substantially toward the X-direction, and a main beam of the antenna array 820 is substantially toward a Z-direction perpendicular to the X-direction. Similarly, the antenna array 820 may comprise one or more transmission antennas or reception antennas, such as patch antennas.

As to element parameters, in an embodiment, the dielectric substrate 110 is an LTCC substrate. The dielectric substrate 110 has a thickness of about 1.45 mm and has a dielectric constant of about 7.5. The foregoing parameters can be adjusted according to desired frequency bands.

The mobile device and the antenna array of the subject application therein have the following advantages: (1) The antenna array is embedded in the dielectric substrate such that design space is saved; (2) The transmission antennas are interleaved with the reception antennas in the antenna array to reduce mutual coupling and to decrease the total length of the antenna array; (3) The antenna array is close to a lateral edge of the dielectric substrate to generate end-fire radiation in a horizontal direction; and (4) The main beam of the antenna array is easily tunable.

The embodiments of the disclosure are considered as exemplary only, not limitations. It will be apparent to those skilled in the art that various modifications and variations can be made on the invention. The true scope of the disclosed embodiments is indicated by the following claims and their equivalents.

What is claimed is:

1. A mobile device, at least comprising:
a dielectric substrate;
an antenna array, comprising:
a first antenna;
a second antenna; and
a third antenna, positioned between the first antenna and the second antenna so as to reduce coupling between the first antenna and the second antenna,
wherein the first antenna, the second antenna and the third antenna are embedded in the dielectric substrate, and are substantially arranged in a straight line;
wherein each of the first antenna and the second antenna is a transmission antenna and the third antenna is a reception antenna, or each of the first antenna and the second antenna is the reception antenna and the third antenna is the transmission antenna; and
wherein the first antenna and the second antenna transmit or receive the same frequency band to form a synthetic beam; and
a transceiver, coupled to the antenna array, and configured to transmit or receive a signal.

2. The mobile device as claimed in claim 1, wherein the dielectric substrate is an LTCC (Low Temperature Co-fired Ceramics) substrate or an FR4 substrate.

3. The mobile device as claimed in claim 1, wherein a distance between the first antenna and the second antenna is approximately half wavelength of a central operating frequency of the antenna array.

4. The mobile device as claimed in claim 1, wherein the antenna array is close to a lateral edge of the dielectric substrate so as to generate end-fire radiation.

5. The mobile device as claimed in claim 4, wherein the antenna array is a first antenna array, and the mobile device further comprises:
a second antenna array, coupled to the transceiver, wherein a main beam of the first antenna array is substantially toward a first direction, and a main beam of the second antenna array is substantially toward a second direction perpendicular to the first direction.

6. The mobile device as claimed in claim 5, wherein the second antenna array is disposed on a surface of the dielectric substrate.

7. The mobile device as claimed in claim 5, wherein the second antenna array is close to another lateral edge of the dielectric substrate so as to generate end-fire radiation.

8. The mobile device as claimed in claim 1, wherein the reception antenna is a slot antenna.

9. The mobile device as claimed in claim 8, wherein the slot antenna comprises:
a first ground structure, having a slot; and
a first feeding element, coupled to a signal source, and extending across the slot of the first ground structure.

10. The mobile device as claimed in claim 9, wherein the slot antenna further comprises:
a cavity structure, coupled to the first ground structure, and having an open side which faces the slot of the first ground structure.

11. The mobile device as claimed in claim 10, wherein the dielectric substrate comprises a plurality of metal layers and a plurality of vias, and the first ground structure and the cavity structure are formed by the plurality of metal layers and the plurality of vias.

12. The mobile device as claimed in claim 10, wherein the first feeding element extends into an interior of the cavity structure.

13. The mobile device as claimed in claim 1, wherein the transmission antenna is a monopole antenna.

14. The mobile device as claimed in claim 13, wherein the monopole antenna comprises:
a second ground structure, having a small hole;
a main radiation element, wherein one end of the main radiation element extends through the small hole of the second ground structure perpendicularly; and
a second feeding element, coupled to the end of the main radiation element, and coupled to a signal source.

15. The mobile device as claimed in claim 14, wherein the main radiation element comprises:
a first radiation sub-element, extending through the small hole of the second ground structure; and
a second radiation sub-element, coupled to the first radiation sub-element.

16. The mobile device as claimed in claim 14, wherein the monopole antenna further comprises:
a reflection structure, close to the main radiation element, coupled to the second ground structure, and substantially perpendicular to the second ground structure.

17. The mobile device as claimed in claim 16, wherein the dielectric substrate comprises a plurality of metal layers and a plurality of vias, and the second ground structure and the reflection structure are formed by the plurality of metal layers and the plurality of vias.

18. The mobile device as claimed in claim 14, wherein the second feeding element comprises a rectangular coaxial cable which is substantially parallel to the second ground structure and substantially perpendicular to the main radiation element.

19. The mobile device as claimed in claim 1, wherein the antenna array covers an array band which is approximately from 57 GHz to 66 GHz.

20. The mobile device as claimed in claim 1, wherein the transceiver is further configured to dynamically adjust the main beam of the antenna array toward a specific direction.

21. The mobile device as claimed in claim 1, further comprising:

a TR (Transmission and Reception) switch, configured to exchange the functions of the transmission antenna and the reception antenna.

* * * * *